United States Patent [19]

MacLeod

[11] 4,128,856

[45] Dec. 5, 1978

[54] AUTOMATIC RESETTING CONTROL CIRCUIT FOR AIR SWITCH OPERATOR

[76] Inventor: Donald A. MacLeod, 6815 Ridgewood Dr., Oakland, Calif. 94611

[21] Appl. No.: 820,039

[22] Filed: Jul. 29, 1977

[51] Int. Cl.[2] ..... H01H 47/32

[52] U.S. Cl. ..... 361/156; 361/167

[58] Field of Search ..... 361/156, 167, 205, 331, 361/335, 376, 392, 394; 320/1; 340/151, 152, 216, 310, 409

[56] References Cited

U.S. PATENT DOCUMENTS

| | | | |
|---|---|---|---|
| 3,742,313 | 6/1973 | Spencer | 361/205 |
| 3,975,666 | 8/1976 | Redding | 361/156 |
| 3,991,006 | 12/1976 | Kratomi | 361/156 |
| 4,045,714 | 8/1977 | MacLeod | 361/156 |

*Primary Examiner*—Gerald Goldberg
*Attorney, Agent, or Firm*—David B. Harrison

[57] ABSTRACT

An automatic resetting subcircuit is disclosed in a remotely actuated power distribution switch control circuit characterized by a two-position electromechanical control for an automatic actuation mechanism for operating the switch. The control is provided with two elements, each for moving the control in an opposite direction between the open and closed positions of the switch. The circuit includes a first energy storage capacitor for storing energy received from a source remote from the circuit. A first thyristor, when triggered by a locally generated control signal, applies the energy stored in the first energy storage capacitor to one of the elements to cause the switch to be operated in a predetermined direction. The automatic resetting subcircuit includes a second energy storage capacitor for storing energy received from the remote source with the second energy storage capacitor being electrically isolated from the first thyristor. A sensor switch responds to the position of the distribution switch and is connected to reverse the connections of the first and second energy storage capacitors in accordance with the position of the power distribution switch. A time delay circuit is provided in conjunction with a second thyristor which is connected to the second energy storage capacitor and to the sensor switch. The gate of the thyristor is connected to the time delay circuit and to a transistor base controlled by the voltage on the first energy storage capacitor. If the voltage thereon goes to zero, indicating a signal switch, and the power distribution switch does not operate, the second thyristor passes the energy stored in the second energy storage capacitor to the other element of the electromechanical control to return the control to its initial position.

7 Claims, 6 Drawing Figures

AUTOMATIC RESETTING CONTROL CIRCUIT FOR AIR SWITCH OPERATOR

BACKGROUND OF THE INVENTION

The present invention relates to automatic control circuitry for a remotely actuated power distribution switch, and more particularly, the present invention relates to an automatic resetting subcircuit within a remote control circuit for a power distribution switch.

For years, air switches have been provided on power distribution poles as well as in subterranean power distribution vaults to enable the power distribution company to interrupt its circuits for maintenance and to cope with circuit overloads and failures. Typically, the switches have been operated by hand, with switches mounted atop power distribution poles being operated from the ground by manual movement of a handle at the base of a vertical rod linked to the air switches at the top of the pole. In those cases operation of the switches, particularly in emergencies has been delayed by the travel time of a technician to the location of the switch.

More recently, it has been proposed to provide a remotely controlled mechanical operator at the base of the power distribution pole, or in the subterranean distribution vault, for the purpose of opening and closing the switches. Typically, such operators include a housing secured to the power pole enclosing a hydraulic ram movable between two extreme positions. The ram moves the vertical rod operating the air switches through appropriate linkages. A reservoir, four-way valve, and hydraulic pump and motor are provided as well as a pressure accumulator so that in the event of a power failure, pressure from the accumulator may be utilized to drive the hydraulic ram to operate the switch. One such operator is described in U.S. Pat. No. 3,806,679 to Pahl. The Pahl system includes a four-way solenoid valve between the hydraulic ram and the rest of the hydraulic circuit. The four-way valve is provided to reverse the flow of hydraulic fluid in the ram to control its movements from one extreme position to the other, in accordance with the position of the valve. The valve is provided with two solenoid windings to move a valve element in both directions between its two operative positions.

The applicant's prior invention, disclosed in U.S. patent application Ser. No. 584,569, filed on Apr. 8, 1975, now U.S. Pat. No. 4,045,714, for Remote Switch Control and Status Indicator System, described a circuit for actuating one of the solenoids of the four-way hydraulic valve in accordance with a command signal from a centrally located control point removed from the power distribution switch. While the applicant's prior invention inter alia solved a problem with the remote actuation hydraulically driven power distribution switches via voltages received from the telephone line, and has enjoyed considerable commercial success, still some problems have persisted in the cases of power distribution switches exposed to severe weather conditions and climate. For example, in winter ice storms, ice accumulations on the power distribution switch may preclude its movement in response to the hydraulic ram when a remote signal is received, unless the ice is first broken.

The pressure of accumulators of the hydraulic actuator for power distribution switches such as the type shown in the Pahl patent typically have the capacity to enable the hydraulic ram to be actuated several times even when no power is available to operate the hydraulic system pump. One drawback of the applicant's prior control circuit invention, application Ser. No. 584,569, was that once triggered, the circuit would not reset unless the distribution switch actually moved. Thus, one drawback of applicant's prior invention was that in the event of icing or corrosion or some other temporary impediment blocking operations of the switch, once the remote control circuitry operated, there was no way to restore the four-way hydraulic valve to its initial position to enable repeated attempts to overcome the ice, corrosion, etc. and operate the switch.

The applicant has found that if the hydraulic ram of the hydraulic actuator system is operated repetitively, often, ice formation, corrosions or other impediments to movement of the power distribution switches are overcome and the switches may then be actuated in the direction, and to the position, intended. Thus a need has arisen for an automatic reset circuit enabling the four-way hydraulic valve to be returned to its initial position shortly after an attempted operation of the switch in the event that it does not move in response to the force on the vertical rod applied by the hydraulic ram. Thus, the present invention enables the control circuit of the applicant's prior invention to be actuated again, and again, until the ice, corrosion or other impediment gives way and the switch moves.

An object of the present invention is to provide an automatic reset circuit for resetting an electromechanical control element in an automatic actuation machanism for a power distribution switch in the event that the switch is temporarily inhibited from operation.

Another object of the present invention is to provide an automatic reset subcircuit which is compatible with a remote control circuit connected to control the actuation mechanism for a power distribution switch.

A further object of the present invention is to provide an automatic resetting subcircuit for a remote control circuit operating the actuation mechanism for a power distribution switch which is characterized by few electrical components, low cost in manufacturing, and reliability in operation.

Yet another object of the present invention is to provide an automatic resetting subcircuit for a remote control circuit for the actuation mechanism controlling a power distribution switch which is fabricated in a small self-contained plug-in unit which may be readily removed and easily replaced thereby facilitating maintenance of the system.

The automatic resetting subcircuit of the present invention works in conjunction with a remotely actuated power distribution switch control circuit. The control circuit is operatively connected to a two position electromechanical control for the actuation mechanism for operating the switch. The control has two electrical elements, each element for moving the control in an opposite direction between two positions corresponding to the open and closed positions of the distribution switch. A first energy storage capacitor stores energy received from a source remote from the remote control circuit, and a locally signalled control subcircuit applies the energy stored in the first energy storage capacitor to one of the elements of the electromechanical control to cause the switch to be operated in a predetermined direction. The automatic resetting subcircuit includes a second energy storage capacitor for storing energy received from the remote source, the second energy storage capacitor being non-responsive to the operation of the first control subcircuit. A sensor switch responsive to the position of the power distribution switch, is connected to the first and second energy storage capacitors for reversing the connections thereto between the control subcircuit and the automatic resetting subcircuit in accordance with the position of the distribution switch. A time delay circuit provides a predetermined time delay within the automatic resetting subcircuit. A reset circuit closure element is connected to the second energy storage capacitor and the other element of the electromechanical control through the sensor switch. A control element on the reset circuit closure element is connected to the time delay circuit, and to a level sensor connected to the first energy storage capacitor so that the reset subcircuit comes into operation in the event that the switch has not been operated despite the actuation of the control subcircuit. The reset subcircuit then returns the electromechanical control to its initial position after said predetermined time delay.

Other objects, advantages and features of the present invention will become apparent from the following detailed description of a preferred embodiment in conjunction with the accompanying drawings.

DETAILED DESCRIPTION OF A PREFERRED EMBODIMENT

Figure 1:
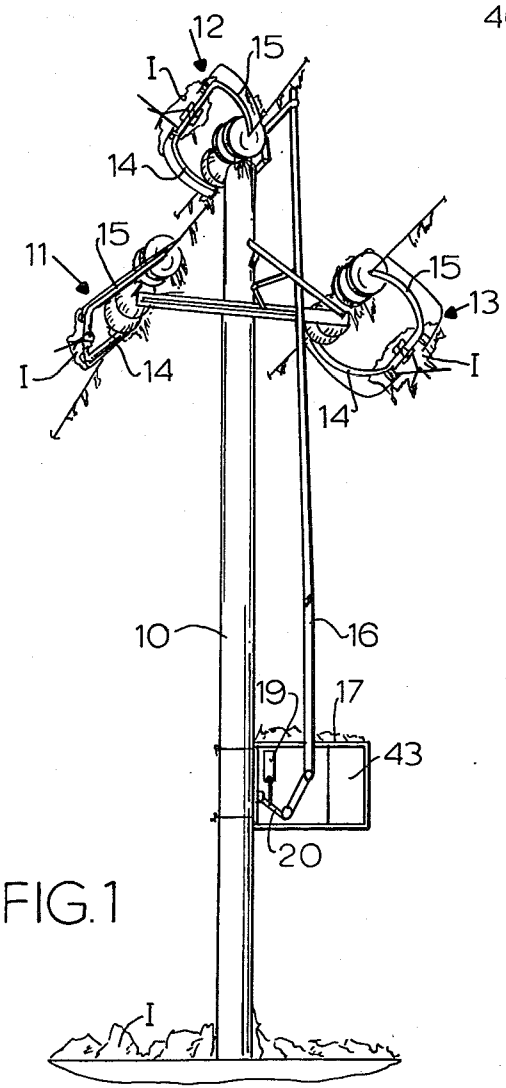
FIG. 1 is a diagrammatic view in elevation of a power distribution pole carrying high voltage power distribution cables and supporting three circuit-disconnect air switches at the top thereof. The switches are operated by a linkage system driven by a hydraulic ram in a housing at the base of the pole. The operation of the hydraulic ram is under the control of an automatic resetting hydraulic operator control in accordance with the principles of the present invention.

Referring to the figures, In FIG. 1, a power distribution pole 10 is implanted in the ground and supports three power circuit-interrupt air switches 11, 12 and 13 exposed to the weather at the top of the pole. Ice I has formed on the switches 11, 12, 13 and this invention provides a way to break this ice. The switches 11, 12 and 13 (shown closed) each include a fixed member 14 and a moving member 15. The moving member 15 is pivotally mounted to the pole 10 and is moved by a linkage 16 which is slideably mounted to the side of the pole 10 and extends to the base of the pole 10 and into a housing 17 containing a hydraulic operator system 18 and a control system incorporating the automatic reset subcircuit in accordance with the present invention. The hydraulic actuator system includes a bidirectional hydraulic ram 19 which is mounted between the housing 17 and a bell crank 20 which is pivotally connected to the linkage 16.

Figure 3:
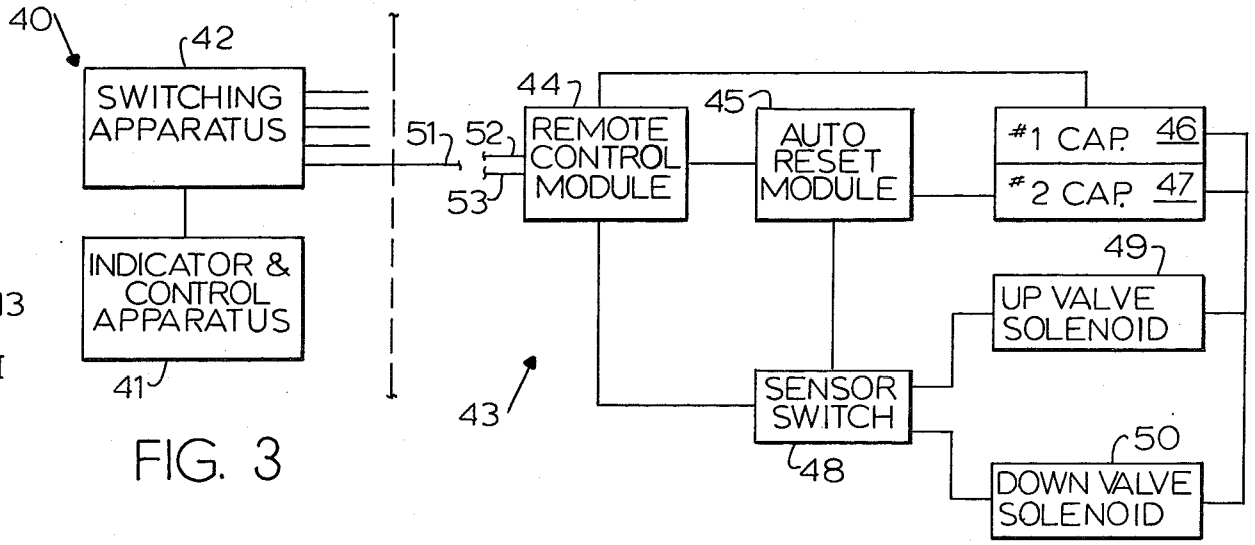
FIG. 3 is a block diagram of a centrally located monitoring and control circuit in cooperative connection via telephone lines with a remotely located automatic resetting hydraulic operator control for an air switch in accordance with the principles of the present invention.
Figure 2:
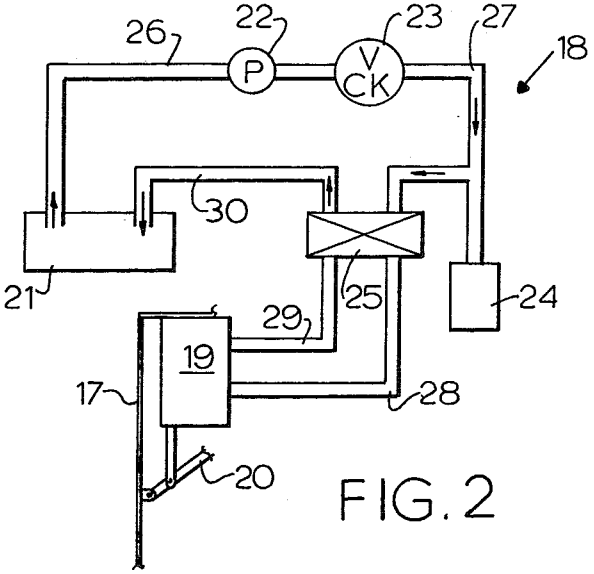
FIG. 2 is a schematic diagram of a hydraulic system controlling the hydraulic ram shown in FIG. 1.

Referring to FIG. 2, the hydraulic circuit of the hydraulic operator system 18 includes in series connection the ram 19, a hydraulic reservoir 21, a motor-driven pump 22, a check valve 23, a high pressure accumulator 24, and a four-way valve 25. The pump withdraws hydraulic fluid from the reservoir 21, through a conduit 26 and passes it through the check valve 23 and via a conduit 27 into the high pressure accumulator 24 as well as into one side of the hydraulic cylinder via one of two conduits 28 or 29, depending upon the position of the valve 25. The other of the conduits 28 or 29 returns the fluid to the reservoir via a conduit 30. The details of the hydraulic circuitry are conventional, not a part of the present invention and are explained in great detail in U.S. Pat. No. 3,806,679 to Pahl, reference to which is made for further particulars. Referring to FIG. 3, a monitoring and control system 40 is shown in block diagram outline as including indicator and control apparatus 41 and switching apparatus 42 at a central control point. The switching apparatus 42 enables the indicator and control apparatus to be switched between an unlimited number of telephone pairs leading to remote control and monitoring systems 43 at different remote locations (there being one such system located within the housing 17 at the power pole 10 shown in FIG. 1).

Each remote control and monitoring system 43 includes a remote control module 44, an automatic reset module 45, two energy storage capacitors 46 and 47 and a sensor switch 48. The capacitors 46 and 47 are connected in common to one side of two solenoids, an upvalve solenoid 49 and a downvalve solenoid 50 which are a part of the four-way valve 25 (FIG. 2). The other sides of the upvalve solenoid 49 and downvalve solenoid 50 are connected to the sensor switch 48 which is in turn connected to the automatic reset module 45. A telephone line 51, leading from the switching apparatus 42, includes a tip wire 52 and a ring wire 53 and is connected to the remote control module 44.

Figure 4:
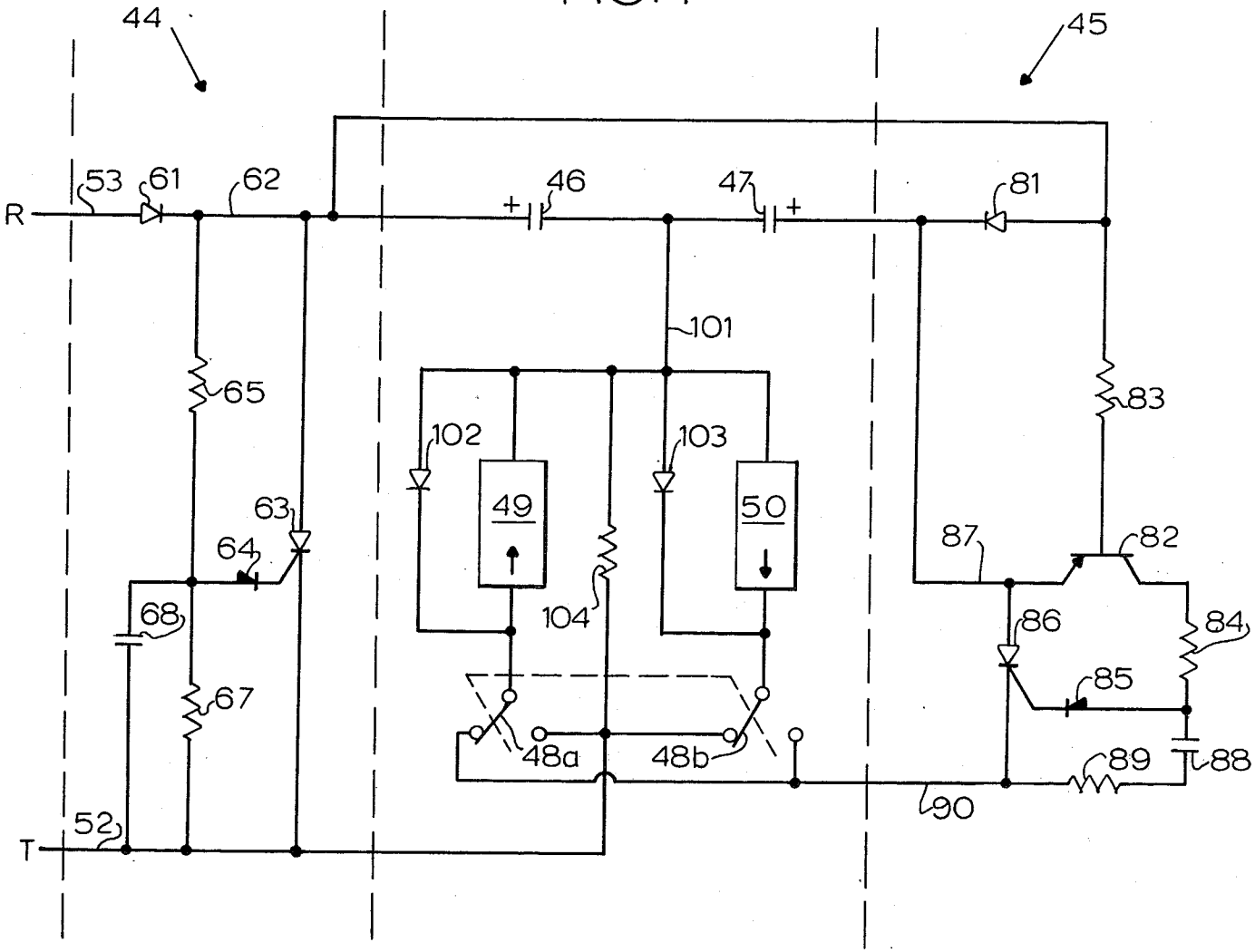
FIG. 4 is a schematic circuit diagram of one embodiment of an automatic resetting hydraulic operator control incorporating the principles of the present invention.

Referring now to FIG. 4, direct current from the control apparatus 41 via the wires 52 and 53 charges the capacitors 46 and 47 when the voltage across the capacitor 46 reaches a predetermined value, the remote control module 44 is actuated automatically and causes the direct current source at the control location to disconnect itself from the telephone pair 52 and 53. The actuation of the remote control module 44 also actuates the reset module 45 (in the event the switches 11, 12, 13 do not operate on account of ice, corrosion, etc.). The switching apparatus 42 is omitted from FIG. 4 to provide greater clarity. Also, monitoring circuitry normally present in the remote control module 44 has been omitted as not necessary to explain the structure and operation of the reset module 45 and its related circuitry, which are one embodiment of the present invention.

The remote control module 44 is seen to include a diode 61 having its anode connected to the ring wire 53 and a cathode connected to a line 62. A normally nonconductive thyristor 63 has an anode connected to the line 62 and a cathode connected to the tip wire 52. A control gate of the thyristor 63 is connected to the cathode of a normally non-conductive trigger diode 64 having a predetermined trigger voltage characteristic. The anode of the trigger 64 is connected through a resistor 65 to the line 62, and the anode is also connected to the tip wire 52 through a capacitor 68 and a resistor 67. The resistors 65 and 67 provide a voltage divider network which biases the trigger diode 64 below conduction until the voltage across capacitor 46 reaches a predetermined value at which time it becomes conductive and discharges capacitor 68 into the control gate of thyristor 63 causing it to conduct.

The automatic reset module 45 is connected to the remote control module 44 via the line 62. An isolating diode 81 has an anode connected to the line 62 and a cathode connected to the second energy storage capacitor 47 and to an emitter of a PNP transistor 82. The base of the transistor 82 is connected through a series resistor 83 to the line 62. When the capacitor 47 is charging, the transistor is biased into non-conduction due to the voltage drop across the diode 81. The collector of the transistor 82 is connected through a resistor 84 to the anode of a normally non-conductive trigger diode 85. The cathode of the trigger 85 is connected to a control gate of a second, normally non-conductive thyristor 86 having its anode connected to the emitter of the transistor 82 at a common node 87 to which also the cathode of the diode 81 and the second capacitor 46 are connected. The anode of the trigger 85 is also connected to a time delay circuit including a series capacitor 88 and a series resistor 84 connected to the collector of the transistor 82. A resistor 89 connects the capacitor 88 to a line 90. The line 90 extends from the sensor switch 48 and also connects to the cathode of the thyristor 86.

The energy storage capacitors 46 and 47 are high capacity electrolytic capacitors having their plus anodes connected respectively to the lines 62 and 87 and their minus electrodes connected to a common line 101. The line 101 is connected to common sides of the upvalve solenoid 49 and the downvalve solenoid 50. A transient suppressor diode 102 is connected across the winding of the upvalve solenoid 49 with its anode connected to the line 101, and another transient suppressor diode 103 is connected across the winding of the downvalve solenoid 50 with its anode connected also to the line 101.

Figure 5:
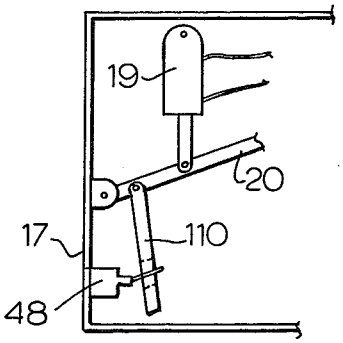
FIG. 5 is a detailed fragmentary view of a control switch of the circuitry of FIG. 4 being operated mechanically by the hydraulic ram shown in FIG. 1.

The sensor switch 48 comprises a two pole, double throw switch which is mechanically linked to the bell crank 20 actuated by the hydraulic ram 19 (as shown in FIG. 5). One set of contacts **48*a* includes a wiper in connection with the upvalve solenoid 49, one fixed contact connected to the line 90 and the other fixed contact to the tip wire 52. The other contact of the set 48*a* is also connected through a resistor 104 to the line 101 connecting the energy storage capacitors 46 and 47 together. The section 48*b* of the switch 48 includes a wiper connected to the downvalve solenoid 50, a fixed contact connected through the resistor 104 to the line 101 and the other fixed contact connected to the line 90. The switch 48** may include additional sections to enable the control module to provide air switch position monitoring functions.

FIG. 5 shows the toggle of the switch 48 to be secured to the housing 17 and mechanically linked to the bell crank 20 by an arm 110. As the crank 20 is driven by the hydraulic ram 19 the arm 110 functions to toggle the switch 48 so that its contacts indicate the position of the air switches 11, 12, 13.

Figure 6:
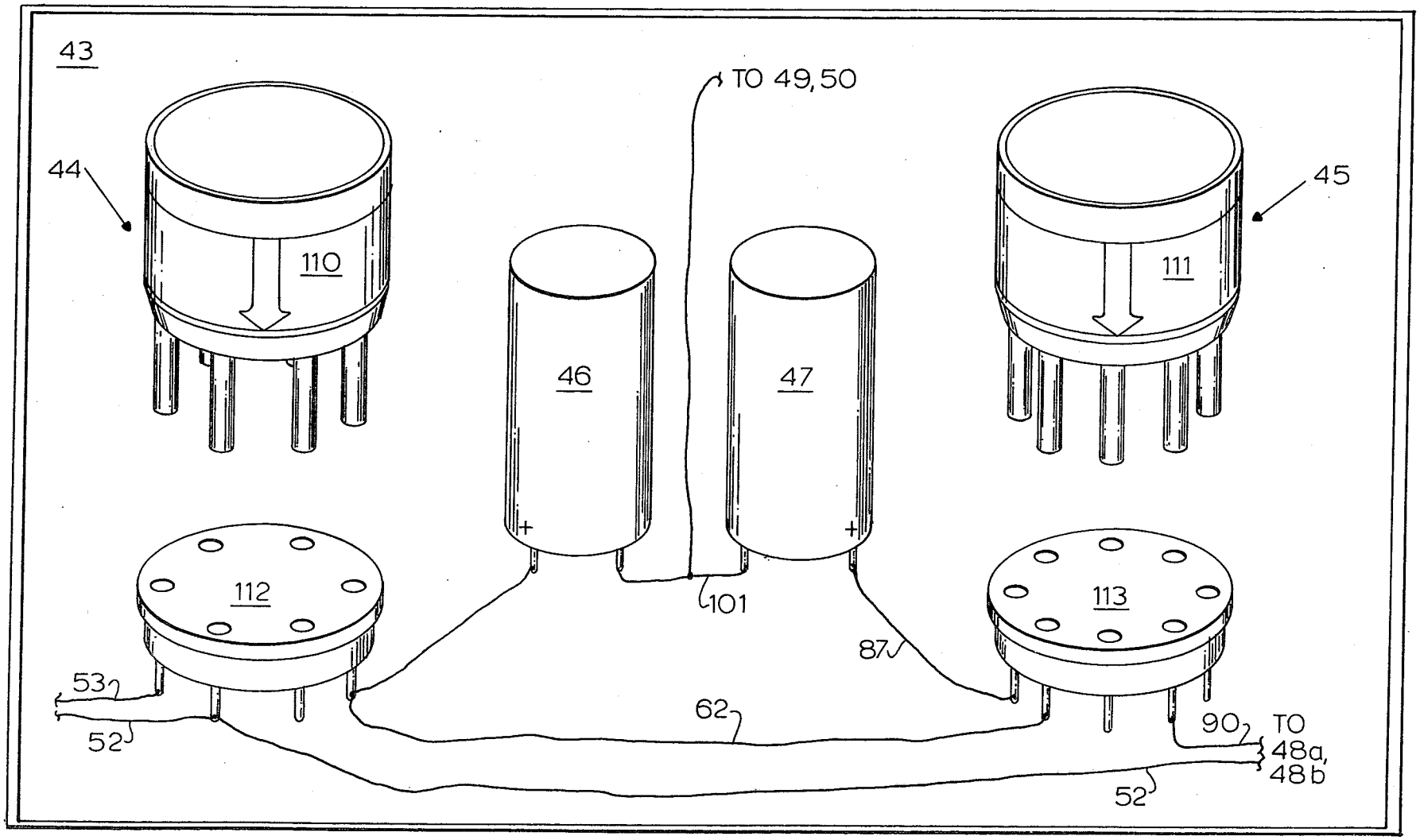
FIG. 6 is a somewhat diagrammatic view in perspective of plug-in modules encapsulating some of the components of the automatic resetting hydraulic operator control shown in FIG 4.

FIG. 6 illustrates one packaging arrangement for the remote control module 44 and the automatic reset module 45. The modules 44 and 45 are shown as encapsulated within plugs 110 and 111 respectively. Receptacles 112 and 113 receive the plugs 110 and 111 and thus enable the modules 44 and 45 to be replaced entirely by simply replacing the plugs 44 and 45. Certain ones of the interconnecting wires are connected to the receptacles, and to the energy storage capacitors 46 and 47 which are also shown.

In operation, when voltage from a dc source is applied across the tip and ring wires 52 and 53, current flows and the energy storage capacitors 46 and 47 become charged, the current passing through the diode 61 in the remote control module 44 to the capacitor 46 and additionally through the diode 81 to the capacitor 47. When the first energy storage capacitor 46 reaches, e.g., approximately 55 volts, the trigger diode 64 reaches its threshold voltage (as determined by the ratio of voltage divider resistors 65 and 67), and becomes conductive, thereupon firing the thyristor 63 which in turn discharges the energy storage capacitor 46 into the downvalve solenoid 50.

In the event of, e.g., ice accumulations at the switches 11, 12, 13 and the hydraulic system 18 is unsuccessful in moving the linkage 16 to operate the switches 11, 12 and 13, a positive voltage remains on the emitter of the transistor 82 while a relative negative voltage from the capacitor 46 is present at the base of the transistor 82. The negative base voltage forward biases the transistor 82 into conduction which enables the capacitor 88 to charge through the resistor 84 in accordance with the time constant thereof. When the capacitor 88 reaches the trigger conducting voltage level of the trigger 85, the second thyristor 86 is triggered into conduction and thereupon discharges the second energy storage capacitor 47 into the upvalve solenoid 49 which returns the valve 25 to its initial position. Then, the system 18 may be actuated again, and again until the ice breaks, and the switches 11, 12, 13 operate.

In the event that the hydraulic system 18 was successful in operating the linkage 16 to its other position, then the second energy storage capacitor 47 is discharged into the downvalve solenoid 50 via the new position of the switch contact **48*b*. As the hydraulic valve 25** is already in the down position, no change in air switch position results therefrom. The foregoing sequence would occur whether the actuation was from the down position to the up position or from the up position to the down position.

Having thus described an embodiment of the invention, it will now be appreciated that the objects of the invention have been fully achieved, and it must be understood that many changes in construction and circuitry and widely differing embodiments and application of the invention will suggest themselves to those skilled in the art to which this invention pertains, without departure from the spirit and scope of the invention. The disclosures and the description herein are purely illustrative and are not intended to be in any sense limiting.

I claim:

1. In a remote control circuit for power distribution switches, valves, and other functionally equivalent devices, said circuit characterized by a two-position electromechanical control for an automatic actuation mechanism for operating said switch, valve, and other functionally equivalent devices, said control having two elements, each element for moving said control in an opposite direction between said two positions and by first energy storage means for storing energy received from a source remote from said circuit and remotely-signalled circuit closure means for applying energy stored in said first energy storage means to one of said elements to cause said switch to be operated in a predetermined direction, an automatic resetting subcircuit comprising:

second energy storage means for storing energy received from said source remote from said circuit;

isolation means connected between said circuit closure means and said second energy storage means for isolating said second energy storage means from said circuit closure means;

sensor means responsive to the position of said switch, valves, and other functionally equivalent devices, and connected to said first and second energy storage means for reversing the connections thereto in accordance with the position of said switch, valve and other functionally equivalent devices;

time delay means for providing a predetermined time delay; and subcircuit closure means connected to said second energy storage means, said other of said elements through said sensor means and said time delay means, for applying, after said predetermined time delay, the energy stored in said second energy storage means to said other element in the event that said switch, valve, and other functionally equivalent devices, has not been operated in response to actuation of said circuit closure means, thereby returning said electromechanical control to its initial position.

2. The automatic resetting subcircuit set forth in claim 1 wherein said time delay means comprises a resistor capacitor network, and said subcircuit closure means comprises a thyristor having an anode and cathode connected between said second energy storage means and said sensor means and having a control electrode, a trigger diode connected between said control electrode and said network, and a gate connected between said second energy storage means and said network, said gate having a control element connected to said first energy storage means, so that said gate passes current from said second energy storage means to charge said network when said first energy storage means is in a discharged state, and so that said trigger diode fires said thyristor when said network has charged to the conduction voltage level of said trigger diode.

3. The automatic resetting subcircuit set forth in claim 1 wherein said second energy storge means comprises a capacitor.

4. The automatic resetting subcircuit set forth in claim 1 wherein said isolation means comprises a diode.

5. The automatic resetting subcircuit set forth in claim 1 further comprising a plug and a receptacle for said plug and wherein said isolation means, said time delay means and said subcircuit closure means are installed in said plug, and said receptacle is connected to said second energy storage means and said sensor means.

6. An automatic reset circuit for use in conjunction with a remote control system for a valve, a switch and other functionally equivalent devices, characterized by two operating positions and two electrical elements for moving between said positions in opposite directions, said circuit comprising:

an energy storage capacitor connected in series with said two electrical elements;

charging means connected to said capacitor for charging it to a predetermined voltage;

a sensor switch responsive to the position of a said valve, switch and other functionally equivalent devices, and connected to said two electrical elements for reversing connections thereto in accordance with said sensed position;

a normally non-conductive thyristor having an anode and cathode connected between said energy storage capacitor and said sensor switch, and having a control gate;

a normally non-conductive trigger diode connected to said control gate;

a resistor-capacitor time delay network connected to said trigger diode;

a transistor gate having an emitter and a collector connected between said energy storage capacitor and said time delay network, and having a base connected to said remote control system and responsive to remote actuation of said system to thereupon render said gate conductive, said time delay network to charge from the voltage stored in said energy storage capacitor, whereupon, after the delay of said network, the threshold voltage of said trigger diode is reached, said trigger diode conducts, and said thyristor then conducts to discharge said energy storage capacitor into one of said electrical elements, it being the opposite element to the one operated by the remote control system in the event of the failure of the said valve, switch and other functionally equivalent device to change operating positions in response to actuation of said remote control system thereby resetting said system, and said element being the same element as the one operated by said system when said valves, switch and other functionally equivalent devices has changed operating positions in response to actuation of said remote control system.

7. The automatic reset circuit set forth in claim 6 further comprising an isolating diode connected between said energy storage capacitor and said charging means for protecting the control modules from current of the wrong polarity.

* * * * *